US006656655B2

(12) United States Patent
Anno et al.

(10) Patent No.: US 6,656,655 B2
(45) Date of Patent: Dec. 2, 2003

(54) TONER FOR DEVELOPING ELECTROSTATIC LATENT IMAGE

(75) Inventors: Masahiro Anno, Sakai (JP); Yoahihiro Mikuriya, Nishinomiya (JP); Masahide Inoue, Suita (JP)

(73) Assignee: Minolta Co., Ltd., Osaka (JP)

( * ) Notice: Subject to any disclaimer, the term of this patent is extended or adjusted under 35 U.S.C. 154(b) by 0 days.

(21) Appl. No.: 09/986,786

(22) Filed: Nov. 9, 2001

(65) Prior Publication Data

US 2002/0098434 A1 Jul. 25, 2002

(30) Foreign Application Priority Data

Nov. 24, 2000 (JP) ..... 2000-357657

(51) Int. Cl.[7] ..... G03G 9/087

(52) U.S. Cl. ..... 430/108.8; 430/109.4; 430/111.4

(58) Field of Search ..... 430/108.1, 108.8, 430/109.4, 110.1, 111.4

(56) References Cited

U.S. PATENT DOCUMENTS 5,614,347 A 3/1997 Aoki et al.
5,660,964 A 8/1997 Machida et al.
5,679,490 A * 10/1997 Yachi et al. ..... 430/110
5,802,440 A * 9/1998 Maeyama ..... 349/327
5,814,428 A 9/1998 Kido et al.
5,905,010 A * 5/1999 Nakamura et al. ..... 430/110
5,932,386 A * 8/1999 Anno et al. ..... 430/106
5,958,642 A 9/1999 Takagi et al.
5,972,547 A 10/1999 Yaguchi et al.
6,291,124 B1 * 9/2001 Ohno et al. ..... 430/111.4
6,335,139 B1 * 1/2002 Gambayashi et al. .... 430/111.4
6,358,657 B1 * 3/2002 Silence et al. ..... 430/109.4

FOREIGN PATENT DOCUMENTS

JP 04-257868 9/1992

* cited by examiner

*Primary Examiner*—John Goodrow
(74) *Attorney, Agent, or Firm*—Burns, Doane, Swecker & Mathis, LLP

(57) ABSTRACT

The present invention relates to a toner for developing an electrostatic latent image comprising a colorant, a binder resin having a number-average molecular weight of 2000 to 5000 and a ratio of weight-average molecular weight/number-average molecular weight of 5 to 30, a polymer having a weight-average molecular weight of 1000 to 3000 and a ratio of weight-average molecular weight/number-average molecular weight of 2.0 or less, and a release agent.

20 Claims, No Drawings

TONER FOR DEVELOPING ELECTROSTATIC LATENT IMAGE

RELATED APPLICAITON

The present invention is based on Japanese Patent Application No. 2000-357657, the contents of which are hereby incorporated by reference.

BACKGROUND OF THE INVENTION

1. Field of the Invention

The present invention relates to a toner for developing an electrostatic latent image to be used in printers and copiers that employ electrophotographic method, electrostatic printing method or the like.

2. Description of the Related Art

In full color image forming apparatuses, generally, part of a toner image is moved to a fixing member during fixing, and a release oil is applied to the fixing member to prevent offset phenomenon soiling the non-image region and prevent the transfer member from wrapping around the fixing member, however, from the perspective of lowering running cost and improving the glossiness of full color images, there have been attempts to reduce the amount of applied release oil. One such attempt, for example, was a method which included a release agent such as wax or the like in the toner particles, however, in this method a disadvantage arose inasmuch as the toner heat resistance during storage was reduced when the toner particles were made small from the standpoint of high quality images, because it was necessary to include a relatively large amount of wax. Furthermore, the chargeability (i.e., charge rise characteristics and charge stability) of this toner was adversely affected. Particularly in full color image forming apparatuses which consume large amounts of toner an frequently replenish toner, when the charge rise characteristics of the toner is poor, replenished toner cannot be quickly charged to a specific charge amount such that the toner charge become dispersed, and fogging is produced. Furthermore, when low charge toner or reverse charge toner is present due to deterioration of toner chargeability, the carrier and charging member become soiled by the toner component in conjunction with long-term use of the toner, thereby reducing charging performance, and producing dispersion in the amount of charge in the toner, and fogging is produced.

Toner is generally produced by fusion kneading colorant and the like in a binder resin, cooling the material, and thereafter finely pulverizing the material and classifying it to a desired grade. When using a binder resin having a relatively high glass transition point in order to improve heat-resistant storage properties, pulverization efficiency is reduced due to the hardness of the resin, and it is difficult to efficiently produce small toner particles.

It is known that the pulverization property of the toner composition improves when so-called pulverization adjuvant (resin more brittle than the binder resin) is added to the toner composition before kneading. For example, Japanese Laid-Open Patent Application No. H4-257868 discloses art incorporating aromatic petroleum resin C7~C10 in a binding resin such as styrene-butadiene resin and the like, U.S. Pat. No. 5,972,547 discloses art incorporating hydrogenated petroleum resin having a hydrogenation rate of 50% or greater in a binder resin, U.S. Pat. No. 5,972,547 discloses art incorporating a copolymer containing styrene monomer and indene monomer in a binder resin, and U.S. Pat. No. 5,958,642 discloses art incorporating a copolymer containing aliphatic hydrocarbon and aromatic hydrocarbon having nine or more carbon atoms in a binder resin.

In the aforesaid art, however, heat-resistant storage characteristics are reduced and fixing characteristics are reduced. When fixing characteristics are reduced, offset phenomenon (anti-offset) occurs, the transfer member wraps around the fixing member (release characteristics) occur, the image is rubbed by the roller when the sheet bearing the formed image is transported for automatic document feeding or duplex copying, such that image quality is reduced due to bleeding and soiling of the image (smear characteristics). Moreover, in the aforesaid art, although the toner composition is easily pulverized, fine particles, and large particles are easily generated, so as to make it difficult to efficiently produce toner particles of a desired size, which is disadvantageous for toner producibility (yield). The toners obtained by the aforesaid art also large amounts of volatile component that are toxic to humans in the vicinity, and are disadvantageous to safety.

OBJECTS AND SUMMARY

An object of the present invention is to provide a toner for electrostatic latent image developing having excellent fixing characteristics and which is suitable for use in fixing methods, which reduce the amount of applied release oil, or oil-less fixing methods.

Another object of the present invention is to provide a toner for electrostatic latent image developing excellent heat-resistant storage characteristics, safety, chargeability, producibility, and image quality.

The present invention relates to a toner for electrostatic latent image developing incorporating a colorant, binder resin having an number-average molecular weight of 2000 to 5000 and a weight-average molecular weight/number-average molecular weight ratio of 5 to 30, a polymer having a weight-average molecular weight of 1000~3000 and a weight-average molecular weight/number-average molecular weight ratio of 2 or less, and a release agent.

DESCRIPTION OF THE PREFERRED EMBODIMENTS

The toner particles comprising the toner of the present invention comprise at least a specific polymer (B), release agent, and colorant dispersed in a binder resin (A). Since there is excellent dispersion of the release agent in the toner particles in the toner of the present invention, the toner is suitable for fixing methods using reduced application amounts of release oil, and preferably oil-less fixing methods, such that there is no reduction in the chargeability and heat-resistant storage characteristics, and excellent fixing characteristics (anti-offset, release characteristics, smear characteristics) are ensured.

In the toner of the present invention, it is desirable that the polymer (B) and the release agent be dispersed at average particle size of 1.5 $\mu$m or less, and it is more desirable that the average particle size of the polymer (B) at this time is smaller than the average particle size of the release agent. In a more desirable mode, normally the polymer (B) dispersed in the toner particles of the present invention have an average particle size of 0.05 to 1.0 $\mu$m, desirably 0.08 to 0.8 $\mu$m, and more desirably 0.1 to 0.5 $\mu$m, and the release agent has an average particle size of 0.2 to 1.5 $\mu$m, desirably 0.4 to 1.5 $\mu$m, and more desirably 0.8 to 1.5 $\mu$m, and the average particle size of the polymer (B) is smaller than the average particle size of the release agent. This structure more effectively ensures excellent production characteristics without excessive pulverization when manufacturing the toner. This structure more effectively ensures toner-fixing characteristics (anti-offset, release characteristics, and smear characteristics) in fixing methods using less release oil and more desirably oil-less fixing methods, chargeability, heat-resistant storage characteristics, and flow characteristics. It is believed the isolation of release agent particles from the toner particles due to stress during developing is effectively prevented, and the probability of exposure of release agent on the surface of the toner particles is effectively reduced.

The dispersed particle size of the polymer (B) and the release agent in the toner particles can be measured by the following method. The particle size distribution of the polymer (B) and release agent in the toner is measured by slicing the toner particle using a microtome, staining with osmium stain, photographing the sample magnified 10,000× using a transmission electron microscope (TEM), and subjecting the photographic image to image analysis (Luzex 5000; Nireco Corp.). Differentiation of the polymer (B) and release agent is possible by dispersing polymer (B) and release agent (and colorant and the like if necessary) independently in resin beforehand, staining each with osmium stain, and observing the samples by TEM, to clarify the differences by staining. Specifically, polymer (B) is stained a gray color by osmium, release agent is stained darker than the polymer (B) and has a lamellate structure, such that it is possible to distinguish between the polymer (B) and the release agent.

In another desirable mode of the present invention, the polymer (B) attains the aforesaid average particle size, and is dispersed densely in the surface layer of the toner particle compared to the core of the toner particle, and more desirably is exposed on the surface of the toner particle, whereas the release agent attains the aforesaid average particle size, and is dispersed uniformly within the toner particle. This structure effectively ensures excellent toner fixing characteristics in fixing methods using less release oil and more desirably oil-less fixing methods, heat-resistant storage characteristics, and chargeability. This structure is believed to allow reduction of the amount of polymer (B) used while ensuring desired pulverization characteristics, and more effectively suppress isolation and exposure of the release agent at the surface of the toner particle. Furthermore, the toner of the aforesaid structure suppresses damage to the toner particles over long-term use, and further suppresses peeling (detachment) of the polymer (B) from the toner particle within the developing device, and it is believed to more effectively prevent spent particles and particle adhesion on the developing sleeve and regulating blade (monocomponent developer) and carrier (two-component developer) of detached particles and part of the toner particles so as to ensure more stable chargeability.

The polymer (B) used in the present invention has a weight-average molecular weight (Mw) of 1000 to 3000 and a weight-average molecular weight/number-average molecular weight ratio (Mw/Mn) of 2.0 or less, and desirably 1.9 or less, and from the perspective of ensuring heat-resistant storage characteristics has a glass transition point (Tg) of 50 to 85° C., and desirably 60 to 80° C., and softening point (Tm) of 100 to 160° C., desirably 110 to 150° C., and more desirably 120 to 145° C.

When the Mw of the polymer (B) is less than 1000, not only are toner storage characteristics (heat-resistant storage characteristics) adversely affected, but fixing efficiency is also adversely affected due to reduced dispersion of release agent in the toner particles. Since volatile components (VOC) within the polymer (B), e.g., acetone, benzene, monomer and the like, are easily retained when Mw of the polymer (B) is too low, these components volatilize during toner manufacture and image formation, and are a problem for safety and noxious odor. That is, when the total VOC of the resin of the polymer (B) exceeds 1000 ppm, it becomes impractical for use. On the other hand, when Mw exceeds 3000, the pulverization characteristics of the main material itself are adversely affected, the expected improvement of the pulverization characteristics provided by the use of the main material is unattained, and stability is adversely affected due to the reduced dispersion of the release agent within the toner particles.

When Mw/Mn is too large, pulverization efficiency is reduced.

In the specification, the Mw and Mn of the polymer and binder the resin are values measured using gel permeation chromatography (model 807-IT; JASCO Corp.).

The glass transition points of the polymer and binder resin are determined by measuring by measurement between 20–120° C. using 10 mg specimen and temperature rise speed of 10° C./min and using alumina as a reference using a differential scanning calorimeter (model DSC-200; Seiko Instruments, Inc.), and setting the shoulder value of the main endothermic peak as the glass transition point.

Furthermore, the softening points are determined as a temperature equivalent to ½ the height from the flow start point to the flow endpoint when a 1 cm3 specimen is melted to flow under 20 kg/cm2 pressure, temperature rise speed of 6° C./min, a dice pore (1 mm diameter; 1 mm length) using a flow tester (model CFT-500; Shimadzu corp.).

The polymer (B) desirably has a pulverization index of 0.1 to 1.0, and more desirably 0.2 to 0.6. The pulverization index is one index expressing ease of pulverization; the smaller the value indicates easier pulverization.

In the specification, the pulverization index uses a value measured under the following conditions. When a specimen having a volume-average particle size of approximately 2 mm is pulverized by a processing quantity F (5 kg/h, KTM rotation speed 12,000 rpm) using a mechanical pulverization device (model KTM-0; Kawasaki Heavy Industries, Ltd), the load force value W0 is recorded when no specimen passes through, and the load force W1 is recorded when specimen passes through. Thereafter, the volume-average particle size D ($\mu$m) of the pulverized material obtained by KTM pulverization is measured by a Coulter Multisizer II (Beckman Coulter Co.). The pulverization index is calculated from the obtained values based on the equation below.

$$\text{Pulverization index}=(D\times(W1-W0))/F$$

The polymer (B) is a well-known styrene type monomer of a homopolymer or copolymer and has a different pulverization index than the binder resin (A), and is incompatible even when fusion kneaded with the binder resin (A). In this instance, "has a different pulverization index than the binder resin (A)" means the pulverization index of the polymer (B) is 0.5 or greater, and desirably 0.7 or greater, than the pulverization index of the binder resin (A). When a styrene type monomer described later and another monomer, e.g., unsaturated aliphatic monomer such as isoprene and butadiene, or copolymer and indene monomer such as indene, are used, the dispersion characteristics of the release agent in the toner particles is reduced, and heat-resistant storage characteristics and chargeability are reduced. Furthermore, safety and noxious odor become problems since volatile components are easily retained.

The styrene type monomer is a monomer having the chemical structural formula (1) shown below.

(1)

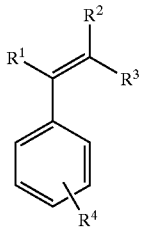

(Where R1, R2, R3, and R4 represent individual hydrogen atoms, halogen atoms, or alkyl group having 1~4 carbon atoms, e.g., methyl group, ethyl group, n-propyl group, n-butyl group; and desirably are a hydrogen atom, chlorine atom, bromine atoms, or methyl group; and more desirably a monomer represented by hydrogen atom, or methyl group.)

Examples of useful styrene type monomers include styrene, vinyl toluene, α-methyl styrene, isopropenyl toluene, β-methylstyrene, 1-propenyl toluene, o-chlorostyrene, m-chlorostyrene, p-chlorostyrene, α-chlorostyrene, β-chlorostyrene, o-bromostyrene, m-bromostyrene, p-bromostyrene, α-bromostyrene, β-bromostyrene and the like; among these desirable examples include styrene, vinyl toluene, α-methylstyrene, isopropenyl toluene, β-methylstyrene, 1-propenyl toluene, and more desirable examples include styrene, and α-methylstyrene.

It is desirable that a homopolymer comprising one monomer is used in the polymer (B) comprised of the aforesaid monomer, and the use of polystyrene, and poly-α-methylstyrene is particularly desirable.

When polystyrene is used as the polymer (B), the weight-average molecular weight is desirably 1000 to 2000.

When poly-α-methylstyrene is used as the polymer (B), the weight-average molecular weight is desirably 2000 to 2800.

Examples of useful polystyrenes and poly-α-methylstyrenes having the aforesaid weight-average molecular weights include styrene and α-methylstyrene synthesized using as raw materials diolefin and monoolefin containing cracked petroleum product generated as a by-product from plants manufacturing ethylene and propylene and the like by petroleum steam cracking. Since such polymer (B) has high raw material purity, the amount of included volatile component is relatively small.

From the perspective of improving fixing characteristics, heat-resistant storage characteristics, chargeability, and production characteristics of the obtained toner, the amount of polymer (B) used is 1.5 to 25 parts-by-weight (hereinafter "pbw"), desirably 2 to 15 pbw, and most desirably 2.5 to 10 pbw, relative to 100 pbw binder resin (A). Polymer (B) may include two or more types of polymers, and in such case the total amount of the multiple polymers is desirably within the aforesaid range.

Wax may be used as a release agent. Fixing characteristics, and particularly anti-offset characteristics and release characteristics are improved in oil-less fixing methods and methods using reduced amount of oil application by including wax, and it is possible to control the glossiness range to a suitably degree without generating gloss irregularities in a wide temperature range. Examples of useful waxes include well-known waxes in the field of electrostatic latent image developing toners such as polyolefin wax such as polyethylene wax and polypropylene wax, natural waxes such as carnauba wax and rice wax, as well as montan wax, Fischer-Tropsch wax, paraffin wax and the like. It is desirable that, in the present invention, the release agent used has a softening point of 60 to 150° C.

Although it is desirable low molecular weight polypropylene and polyethylene as the polyolefin wax from the standpoint of ensuring toner release characteristics with the fixing device, there is a disadvantage of toner flow characteristics due to small degree of hardness of polyolefin wax of low molecular weight, and to improve this disadvantage it is desirable to use wax denatured by carboxylic acid or acid anhydride. Particularly usable as a polypropylene resin is low molecular weight polypropylene resin modified by one or more types of acidic monomer selected from a group comprising (meth)acrylic acid, maleic acid and maleic anhydride. Modified polypropylene by be obtained by, for example, grafting or additionally reacting polypropylene resin with acidic monomer of one or more types selected from among a group comprising (meth)acrylic acid, maleic acid, and maleic anhydride in the presence of peroxide catalyst or noncatalyst. When using modified polypropylene, it is desirable that the acid value is 0.5 to 30 KOHmg/g, and more desirably 1 to 20 KOHmg/g. Examples of usable modified polypropylene, i.e., acidic polypropylene wax, include commercial products such as Biscol 200TS (Sanyo Chemical Industries; softening point: 140° C.; acid value: 3.5 KOHmg/g), Biscol 100TS (softening point: 140° C.; acid value: 3.5 KOHmg/g), and Biscol 110TS (softening point: 140° C.; acid value: 3.5 KOHmg/g).

Commercial polyethylene wax, or acidic polyethylene wax may be used as the polyethylene wax, for example, Sanwax E300 (Sanyo Chemical Industries; softening point: 103.5° C.; acid value: 22 KOHmg/g), Sanwax E250P (softening point: 103.5° C.; acid value: 19.5 KOHmg/g), Sanwax E310 (acid value: 15 KOHmg/g), Hiwax 4053E (Mitsui Chemicals, Inc.; softening point: 145° C.; acid value: 25 KoHmg/g), Hiwax 405MP (softening point: 128° C.; acid value: 1.0 KOHmg/g), Hiwax 310MP (softening point: 122° C.; acid value: 1.0 KOHmg/g), Hiwax 320MP (softening point: 114° C.; acid value: 1.0 KOHmg/g), Hiwax 210MP (softening point: 118° C.; acid value: 1.0 KOHmg/g), Hiwax 220MP (softening point: 113° C.; acid value: 1.0 KOHmg/g), Hiwax 4051E (softening point: 120° C.; acid value: 12 KOHmg/g), Hiwax 4052E (softening point: 115° C.; acid value: 20 KOHmg/g), Hiwax 4202E (softening point: 107° C.; acid value: 17 KOHmg/g), Hiwax 2203A (softening point: 111° C.; acid value: 30 KOHmg/g) and the like. The acidic polyethylene wax desirably has an acid value of 0.5 to 30 KOHmg/g, and more desirably 1 to 20 KOHmg/g.

Carnauba wax has fine crystals and desirably an acid value of 0.5 to 10 KOHmg/g, and more desirably 1 to 6 KOHmg/g.

Montan wax is generally a montan ester wax refined from minerals, and may have a fine crystals similar to carnauba wax; the acid value is desirably 1 to 20 KOHmg/g, and more desirably 3 to 15 KOHmg/g.

Rice wax is air oxidized rice bran wax and desirably has an acid value of 5 to 30 KOHmg/g.

Fischer-Tropsch wax is a wax by-product produced when manufacturing synthetic oil from coal by hydrocarbon synthesis method, e.g., a commercial produce marketed under the brand name of Sazol produced by Sazol Company. Furthermore, separate from this, Fischer-Tropsch wax that has natural gas as a raw material has little low molecular weight component, and provides heat resistance is excellent when used in a toner.

Fischer-Tropsch wax having an acid value of 0.5~30 KOHmg/g may be used, and among Sazol waxes, the acidic type having an acid value of 3 to 30 KOHmg/g (product name: Sazol wax A1, A2 and the like) is suitable.

The release agent in the present invention is desirably two types of wax having different softening points used together. For example, the use of a wax having a softening point of 60 to 110° C. (hereinafter referred to as "low softening point wax") and wax having a softening point of 110 to 150° C. (hereinafter referred to as "high softening point wax") are desirable. Release characteristics between the fixing device (fixing member) and media (transfer body) over a wide temperature range are easily ensured by using two types of waxes having different softening points. Furthermore, the fixing temperature range in which offset does not occur (anti-offset range) can be broadened. At this time, the softening points of the two types of wax desirably differ by at least 20° C. or more, and more desirably 30° C. or more.

The type of high softening point wax is not specifically limited, but the use of polypropylene wax is desirable from the perspective of even greater improvement of anti-offset characteristics and the like. A polypropylene wax having a melt viscosity of 50 to 300 cps at 160° C., and an acid value of 1 to 20 KOHmg/g is desirable for use as the polypropylene wax. A polypropylene wax having the aforesaid melt viscosity, softening point and acid value has particularly excellent dispersibility in binder resin (A) described later, effectively prevents the problem of isolated wax, and effectively improves anti-offset characteristics. An acid type polypropylene wax is desirable particularly when polyester resin is used as the binder resin.

The type of low softening point wax is not specifically limited, however, from the perspectives of improving smear characteristics (i.e., a phenomenon causing low image quality due to bleeding and soiling of an image when a sheet bearing an image on one side is rubbed by a roller during automatic document feeding or duplex copying, suitable waxes include various types of natural wax (carnauba wax, rice wax), Fischer-Tropsch wax, montan wax, paraffin wax, low molecular weight polyolefin wax (polyethylene wax, polypropylene wax) and the like, and among which the most desirable are montan wax and polyethylene wax. Polyethylene wax is the most desirable. The most desirable polyethylene wax has a melt viscosity of 200 to 1000 cps at 140° C., and an acid value of 0 to 20 KOHmg/g. A polyethylene wax having the aforesaid melt viscosity, softening point, and acid value has excellent dispersibility in the binder resin, and effectively improves smear characteristics by reducing the friction coefficient of the fixed image surface while effectively preventing problems due to isolated wax.

The wax melt viscosity is a value measured by bulk field viscometer.

The wax softening point is a value measured by the same method as the resin softening point-measuring method.

The wax acid value is a value measured by the same method as the resin acid value measuring method.

The amount of added release agent is 2 to 20 pbw, desirably 3 to 15 pbw, and more desirably 3 to 10 pbw, relative to 100 pbw binder resin (A). When two or more types of wax are used in the release agent, the total amount of all waxes should be within the aforesaid range.

In the present invention, for the purpose of maintaining high dispersibility and high loading of release agent, a means for incorporating release agent when synthesizing the binder resin, means for graft/block polymerization of binder resin, and specifically vinyl resin to the polyester resin, means for graft/block polymerization of release agent component and binder resin, and means for graft/block polymerization of binder resin, and particularly monomer or copolymer having a function group with affinity for polyester resin, to part of the release agent component may be used. Use of such means easily provides stable control of dispersed particle size of the release agent within the binder resin, and dispersibility of the release agent with the binder resin is improved by graft/block polymerization of a vinyl resin or the like to the release agent itself, making it easy to control the dispersed particle size in a release agent high-loading system. Graft/block polymerization disperses release agent in a domain state within the binder resin. Release agent dispersed in a domain state within the binder resin produces a release effect by quickly emerging to the surface of the toner during fixing; the release effect is reduced when the release agent is completely compatible with the binder resin.

The binder resin (A) has a number-average molecular weight (Mn) of 2000 to 5000, desirably 2000 to 4000, and more desirably 2000 to 3500, and has a weight-average molecular weight/number-average molecular weight ratio of 5 to 30, desirably 7 to 28; from the perspective of improving heat-resistant storage characteristics, improving dot reproducibility, oil-less fixing performance (fixing strength, separation from the roller), and improving color reproducibility as a full color toner, the glass transition point is 50 to 70° C., desirably 55 to 65° C., and the softening point is 95 to 160° C., desirably 100 to 150° C.

When Mn is too large, adequate fixing strength cannot be obtained, and color reproduction and gloss characteristics are adversely affected in full color images at practical fixing temperature. When Mn is too small, release characteristics and anti-offset temperature range practical for fixing cannot be ensured.

When the Mw/Mn ratio is too large, color reproduction and glassiness in full color images cannot be obtained. When the Mw/Mn ratio is too small, release characteristics and anti-offset temperature range in oil-less fixing cannot be ensured.

The type of binder resin (A) is not specifically limited insofar as it has the previously described relationship of pulverization characteristics and incompatibility with polymer (B); binder resins well-known in the field of electrostatic latent image developing toner may be used, e.g., polyester resin, styrene-(meth)acrylic copolymer resin, epoxy resin and the like.

In the present invention, it is desirable that polyester resin is used to improve fixing characteristics (anti-offset characteristics, release characteristics, smear characteristics) of a toner used in fixing methods which reduce the amount of applied release agent oil, and desirably oil-less fixing methods.

The polyester resin used may be a polyester resin obtained by condensation polymerization of a polyvalent alcohol component and polyvalent carboxylic acid component.

Examples of useful bivalent alcohol components among the polyvalent alcohol components include bisphenol-A alkylene oxide compounds such as polyoxypropylene(2,2)-2,2-bis(4-hydroxyphenyl) propane, polyoxypropylene(3,3)-2,2-bis(4-hydroxyphenyl) propane, polyoxypropylene(6)-2,2-bis(4-hydroxyphenyl) propane, polyoxyethylene(2,0)-2,2-bis(4-hydroxyphenyl) propane and the like, ethylene glycol, diethylene glycol, triethylene glycol, 1,2-propylene glycol, 1,3-propylene glycol, 1,4-butane diol, neopentyl glycol, 1,4-butene diol, 1,5-pentane diol, 1,6-hexane diol, 1,4-cyclohexane dimethanol, dipropylene glycol, polyethylene glycol, polytetramethylene glycol, bisphenol-A, hydrogenated bisphenol-A and the like.

Examples of useful trivalent alcohol components include sorbitol, 1,2,3,6-hexanetetrol, 1,4-sorbitane, pentaerythritol, dipentaerythritol, tripentaerythritol, 1,2,4-butane triol, 1,2,5-pentane triol, glycerol, 2-methylpropane triol, 2-methyl-1,2,4-butane triol, trimethylol ethane, trimethylol propane, 1,3,5-trihydroxymethyl benzene and the like.

Examples of useful bivalent carboxylic acid components among the polyvalent carboxylic acid component include maleic acid, fumaric acid, citraconic acid, itaconic acid, glutamic acid, phthalic acid, isophthalic acid, terephthalic acid, cyclohexane dicarboxylic acid, succinic acid, adipic acid, sebacic acid, azelaic acid, malonic acid, n-dodecenylsuccinic acid, isododecenyl succinic acid, n-dodecylsuccinic acid, isododecyl succinic acid, n-octenylsuccinic acid, isooctenylsuccinic acid, n-octylsuccinic acid, isooctyl succinic acid, and acid anhydrides or low-molecular alkyl esters thereof.

Useful examples of trivalent carboxylic acid components include 1,2,4-b3nzene tricarboxylic acid (trimellitic acid), 1,2,5-benzene carboxylic acid, 2,5,7-naphthalene tricarboxylic acid, 1,2,4-napthalene tricarboxylic acid, 1,2,4-butane tricarboxylic acid, 1,2,5-hexane tricarboxylic acid, 1,3-dicarboxyl-2-methyl-2-methylene carboxypropane, 1,2,4-cyclohexane tricarboxylic acid, tetra(methylenecarboxyl) methane, 1,2,7,8-octane tetracarboxylic acid, pyromellitic acid, Empol trimer acid, and acid anhydrides and low-molecular alkyl esters thereof.

In the present invention, from the perspective of improving dispersibility of the release agent in the toner particles, the polyester resin used is a polyester resin obtained using a mixture of monomer raw material of polyester resin, monomer raw material of vinyl resin, and monomer for reacting with both monomer raw materials, and subjected in parallel within the same vessel to condensation polymerization reaction for obtaining polyester resin, and radical polymerization for obtaining vinyl resin. The monomer reacted with the raw material monomers of both resins is a monomer usable in both condensation polymerization reaction and radical polymerization reaction. That is, the monomer has a carboxyl group for condensation polymerization reaction, and vinyl group for radical polymerization reaction; e.g., fumaric acid, maleic acid, acrylic acid, methacrylic acid and the like.

The monomer raw material of the polyester resin may be the previously mentioned polyvalent alcohol component, and polyvalent carboxylic acid component.

Useful examples of monomer raw material for the vinyl resin include styrene or styrene derivatives such as styrene, o-methylstyrene, m-methylstyrene, p-methylstyrene, α-methylstyrene, p-ethylstyrene, 2,4-dimethylstyrene, p-tert-butylstyrene, p-chlorstyrene and the like, ethylene unsaturated monoolefin such as ethylene, propylene, butylene, isobutylene and the like, methacrylate alkyl ester such as methyl methacrylate, n-propyl methacrylate, isopropyl methacrylate, n-butyl methacrylate, isobutyl methacrylate, t-butyl methacrylate, n-pentyl methacrylate, isopentyl methacrylate, neopentyl methacrylate, 3-(methyl) butyl methacrylate, hexyl methacrylate, octyl methacrylate, nonyl methacrylate, decyl methacrylate, undecyl methacrylate, dodecyl methacrylate and the like, acrylic alkyl esters such as methyl acrylate, n-propyl acrylate, isopropyl acrylate, n-butyl acrylate, isobutyl acrylate, t-butyl acrylate, n-pentyl acrylate, isopentyl acrylate, neopentyl acrylate, 3-(methyl)butyl acrylate, hexyl acrylate, octyl acrylate, nonyl acrylate, decyl acrylate, undecyl acrylate, dodecyl acrylate and the like, unsaturated carboxylic acid acrylic acid, methacrylic acid, itaconic acid, maleic acid and the like, acrylonitrile, maleate, vinylchloride, vinylacetate, vinylbenzoate, vinylmethylethyl ketone, vinylhexyl ketone, vinylmethyl ether, vinylethyl ether, vinylisobutyl ether and the like. Polymerization initiators which can be used for polymerization of the monomer raw material of the vinyl resin include, for example, azo or diazo polymerization initiators such as 2,2'-azobis(2,4-dimethylvaleronitrile), 2,2'-azobisisobutylonitrile, 1,1'-azobis(cyclohexane-1-carbonitrile), 2,2'-azobis-4-methoxy-2,4-dimethylvaleronitrile and the like, peroxide polymerization initiators such as benzoyl peroxide, methylethyl ketone peroxide, isopropyl peroxycarbonate, lauroyl peroxide and the like.

In the present invention, it is desirable that two types of polyester resin having different softening points are used as the polyester resin to better improve fixing characteristics, particularly in oil-less fixing toners, and to effectively control image glossiness in full color toners having necessary light transmittance. It is desirable that a first polyester resin used has a softening point of 80 to 125° C., and more desirably 90 to 115° C., to improve release characteristics, and a second polyester resin used has a softening point of 130 to 160° C. to improve anti-offset characteristics. The glass transition points of the first and second polyester resins are desirably 50 to 75° C., and more desirably 55 to 70° C., to improve heat-resistant storage characteristics and fixing strength. When using two types of resin in the binder resin in this way, the Mn, Mw/Mn, Tg, and Tm of the mixed resins are within the previously described ranges.

The first polyester resin is desirably a polyester resin obtained by condensation polymerization of the aforesaid bivalent alcohol component and bivalent carboxylic acid component, and it is particularly desirably that a bisphenol-A alkylene oxide compound is a main component as the bivalent alcohol component, and at least one among a group comprising terephthalic acid, fumaric acid, dodecenylsuccinic acid, benzene tricarboxylic acid is selected as the main component as bivalent carboxylic acid component.

The second polyester resin is desirably a polyester resin obtained by condensation polymerization of the aforesaid bivalent alcohol component and polyvalent carboxylic acid component including a trivalent carboxylic acid component, and it is particularly desirable that a bisphenol-A alkylene oxide compound is a main component as the bivalent alcohol component, trimellitic acid is used as the trivalent carboxylic acid component, and at least one among a group comprising terephthalic acid, fumaric acid, dodecenylsuccinic acid, benzene tricarboxylic acid is selected as the main component as bivalent carboxylic acid component. The polymer polar ratio of the trivalent carboxylic acid component is 0.5 to 5 mol %, and desirably 1 to 3 mol %, relative to the total monomer.

The second polyester resin may be a polyester resin obtained using a mixture of monomer raw material of polyester resin, monomer raw material of vinyl resin, and monomer for reacting with both monomer raw materials, and subjected in parallel within the same vessel to condensation polymerization reaction for obtaining polyester resin, and radical polymerization for obtaining vinyl resin. Such a resin is desirable from the perspectives of improving wax dispersibility, toner strength, dispersibility, and anti-offset characteristics. In this case, the vinyl resin content in the second polyester resin is 5 to 40 wt %, and desirably 10 to 35 wt % so as to effectively disperse the release agent within the toner particle.

The weight ratio of the first polyester resin and second polyester resin is 80:20 to 5:95, desirably 70:30 to 20:80, and more desirably 60:40 to 30:70. By using the first polyester resin and the second polyester resin within this range, a toner is obtained which has excellent dot reproducibility little toner breakdown due to crushing of toner during fixing, and excellent fixing characteristics are ensured in low temperature fixing and in both low-speed and high-speed image forming devices. Furthermore, excellent dot reproducibility is maintained even during duplex image formation (passing twice through the fixing device).

In the present invention, a vinyl resin may be included as a binder resin. By including a vinyl resin, the dispersed particle size of the release agent can be suitably controlled. It is desirable that the amount of added vinyl resin is 5 to 40 wt % of the binder resin.

The binder resin (A) has an acid value of 5 to 50 KOHmg/g, and desirably 5 to 40 KoHmg/g. In particular, by using a resin having this acid value when using a polyester resin, the dispersibility is improved in carbon black, colorant, and polymer (B), release agent, and a toner is obtained which has adequate charge. Furthermore, charge stability is ensured relative to environment fluctuation, particularly temperature fluctuation. That is, when the acid value is too high, charge reduction occurs, particularly under environmental conditions of high temperature and high humidity (HH). When two types of resin are used as the binder resin, the acid value of the resin mixture is desirably within the previously described range.

The acid value is a value calculated from the amount of N/10 potassium hydroxide/alcohol solution consumed by titrating indexed N/10 potassium hydroxide/alcohol solution using 10 mg specimen dissolved in 50 ml toluene and a mix indicator of 0.1% bromothymol blue and phenol red.

In the present invention, epoxy resin may be used as part or all of binder resin (A). Epoxy resin used in the present invention may be a condensation polymerization product of bisphenol-A and epichlorohydrin. For example, Epomik R362, R364, R365, R367, R369 (Mitsui Chemicals, Inc.), Epotohto YD-011, YD-012, YD-014, YD-904, YD-017 (Tohto Kasei Co., Ltd.), Epicoat 1002, 1004, 1007 (Schell Chemicals, Ltd.).

Colorant used in the present invention may be well-known pigments and dyes use as colorant in conventional full color toners. Examples of useful colorant include carbon black, aniline black, carcoil blue, chrome yellow, ultramarine blue, Du Pont oil red, quinoline yellow, methylene blue chloride, copper phthalocyanine, malachite green oxalate, lamp black, rose bengal, C.I. pigment red 48:1, C.I. pigment red 122, C.I. pigment red 57:1, C.I. pigment red 184, C.I. pigment yellow 97, C.I. pigment yellow 12, C.I. pigment yellow 17, C.I. solvent yellow 162, C.I. pigment yellow 180, C.I. pigment yellow 185, C.I. pigment blue 15:1, C.I. pigment 15:3 and the like.

The colorant content in the magenta, cyan, and yellow toners is desirably 2 to 15 pbw relative to 100 pbw binder resin (A). It is particularly desirable to use a load quantity of colorant to improve coloring power for the purpose of reducing the amount of toner consumption by small particle size. Although the colorant content differs by type at this time, it is desirable to use 4 to 15 pbw relative to 100 pbw binder resin (A). It is desirable that colorant used in magenta, cyan, and yellow toners are used as a master batch obtained by fusion kneading with the binder resin (A) beforehand, and thereafter pulverizing the mix, and the amount used at this time shall be such that the colorant content in the obtained toner is within the aforesaid range.

In black toner, part or all of the colorant such as carbon black, activated carbon, titanium black and the like may be substituted with magnetic material. In the present invention, it is desirable that the colorant content in nonmagnetic black toner is 3 to 15 pbw relative to 100 pbw binder resin (A). Examples of usable magnetic material include well-known magnetic particles such as ferrite, magnetite, iron and the like.

When obtaining the toner of the present invention, first, the binder resin (A), polymer (B), release agent, colorant and other additives, e.g., charge controller and the like, are mixed in a well-known mixing device such as a Henschel mixer, subsequently fusion kneaded by a well-known kneading device, then cooled to obtain kneaded material. Although a device having one, two or more rotating shafts (screw, rotor, roller or the like) may be used as the kneading device, a screw extruder is mainly used from the perspectives of continuous production and long-term durability.

In the present invention, the kneaded material, and polymer (B) are uniformly dispersed ion the binder resin (A), and the average dispersed particle size is controlled to 0.05 to 2.5 $\mu$m, desirably 0.08 to 2 $\mu$m, and more desirably 0.1 to 1.5 $\mu$m. It is even more desirable that 95% or more of the dispersed particles of polymer (B) are less than 2 $\mu$m in size. By controlling the dispersion state of the polymer (B) in the kneaded material as described above, the kneaded material in a later pulverization process are pulverized while forming a pulverization surface connecting the dispersed particles of the polymer (B), and as a result the polymer (B) particles are densely dispersed in the surface layer of the toner particles compared to in the core of the toner particles, and are desirably exposed on the surface of the toner particles, whereas the release agent is uniformly dispersed in the toner particles such that toner particles can be easily produced. Since pulverization originates not at the contact surface (interface) between the binder resin (A) and polymer (B) particles but rather within the interior of the polymer (B) particles by the presence of polymer (B) particles in the aforesaid size within the kneaded material, the pulverization surface is constructed by the polymer (B) with the result that the obtained toner particles have the aforesaid structure.

When the dispersed particle size of the polymer (B) in the kneaded material is too large, the obtained toner particle does not have densely dispersed polymer (B) in the surface layer. Since it is difficult to ensure the linkage of polymer (B) particles in the surface layer when the polymer (B) dispersed particle size is too large in the kneaded material, it is believed that when the kneaded material is being pulverized, pulverization to link the polymer (B) particles does not occur, but rather pulverization occurs with the polymer (B) particle as the center point of origin, and it is impossible to control the pulverization surface. Although it is thought that the majority of the polymer (B) used ensures the linkage of the dispersed particles of polymer (B) in the kneaded material, when the amount used is increased, excessive pulverization occurs during the pulverization process, such that the desired toner particle size distribution is not obtained and the direct yield of manufacture is reduced. On the other hand, when the dispersed particle size of the polymer (B) is too small, toner particle having the polymer (B) densely dispersed in the surface layer cannot be obtained. When the dispersed particle size is too small, a condition arises wherein the connection of dispersed particles of the polymer (B) in the kneaded material cannot be specified (controlled), and pulverization cannot be attained in the interior part of the polymer (B) particle during pulverization, such that the pulverization surface cannot be controlled.

After fusion kneading, the dispersion state of the polymer (B) in the cooled kneaded material is controlled by suitably changing the volume-average particle size of the polymer (B) used, the mixing conditions prior to kneading, and the kneading conditions. That is, when the particle size of the polymer (B) used is reduced, the dispersed particle size of the polymer (B) in the kneaded material becomes smaller. Furthermore, when the mixing conditions and kneading conditions are strengthened, the average dispersed particle size of the polymer (B) in the kneaded material becomes smaller. Specifically, for example, when a polymer (B) having a volume-average particle size of 1 to 5 mm is mixed with other toner material in a Henschel mixer and fusion kneaded by a dual-shaft extrusion kneader (model PCM-30; Ikegai Tekko, K.K.), normally, a kneaded material having uniform dispersed particle size of polymer (B) can be obtained by mixing for 2 to 10 min with the Henschel mixer mixing speed set at 20 to 50 m/s, and kneading the material in the kneading device for 1 to 5 min with the kneading device kneading temperature set at 120 to 200° C.

Since the dispersed particle size of the polymer (B) in the kneaded material is difficult to measure, the polymer (B) dispersed particle size may be within the aforesaid range in the particles of the toner coarsely pulverized material pulverized to a volume-average particle size of approximately 2 mm during a pulverization process described later. The dispersed particle size of the polymer (B) in the kneaded material and the dispersed particle size of the polymer (B) in the particles of the coarsely pulverized toner particles pulverized to a volume-average particle size of approximately 2 mm are not changed. The dispersed particle size of the polymer (B) in the particles of the coarsely pulverized toner particles pulverized to a volume-average particle size of approximately 2 mm can be measured by the same method as the measuring method used for the dispersed particle size of the polymer (B) in the toner particles.

Next, the obtained kneaded material is pulverized, classified, and subjected to desired surface improvement processing. In the pulverization process, normally, after coarse pulverization of the kneaded material by feather mill or the like, the particles are finely pulverized by a mechanical pulverizer using high-speed airflow impact method such as the Kryptron system (KTM; Kawasaki Heavy Industries, Ltd.), Inomizer system (Hosokawa Micron Corp.), Fine mill (Nippon Pneumatic Mfg. Co., Ltd.) and Turbo mill (Turbo Kogyo Co. Ltd.) and the like, and/or a jet mill wherein toner particles pulverize each other or through impact with an impact blade while riding a jet airflow such as model I jet mill, PJM (both by Nippon Pneumatic Mfg. Co., Ltd.), AFG (Hosokawa Micron Corp.) and the like. It is desirable that after the kneaded material is coarsely pulverized by the feather mill to a volume-average particle size of approximately 2 mm, it is finely pulverized to approximately a volume-average particle size of 10 $\mu$m by a mechanical pulverizer such as the Kryptron system (KTM; Kawasaki Heavy Industries, Ltd.), then finely pulverized using a jet mill such as a jet pulverizer (IDS; Nippon Pneumatic Mfg. Co., Ltd.). In the present invention, it is desirable that the particle is pulverized to a volume-average particle size of the final particle of 4 to 8 $\mu$m, and more desirably 5 to 7 $\mu$m.

Well-known classification devices capable of classifying pulverized material at a desired particle size may be used as the classification device used in the classification process, e.g., Elbow jet (Nittetsu Mining Co., Ltd.), DS classifier (Nippon Pneumatic Mfg. Co., Ltd.), T-plex classifier (Hosokawa Micron Corp.) and the like. It is desirable that the device used is a T-plex classifier (Hosokawa Micron Corp.), which is capable of sphericalizing, processed particles.

Well-known charge controllers from the field of electrostatic latent image developing toners may be added as the charge controller added as necessary to the toner of the present invention. Examples of useful charge controllers include high molecular weight acids of copolymers containing maleic acid, metal dyes such as fluoride surfactant, metal salicylic acid complex, azo metal compound and the like as monomer components. Among these, metal salicylic acid complex is desirable, and metal salicylic acid complex containing boron atoms is particularly suitable for the present invention. The amount added differs according to the process used and structure of other materials, however, a range of 0.1 to 5 pbw, and desirably 0.5 to 3 pbw, relative to 100 pbw binder resin (A) is suitable. When the toner of the present invention has a structure wherein the polymer (B) is densely dispersed in the surface layer of the toner particle compared to the core of the toner particle, the toner has sufficient charge performance for practical use even without a charge controller added inasmuch as the polymer (B) has a negative charge. Moreover, the charge may be designed in accordance with various types of processes by adding charge controller as necessary.

Various types of resins (charge controllers) having a polar function group such as sulfonic acid group, fluoride-containing group, silicon containing group and the like having effective negative chargeability also may be added to the toner. The charge controlling resin (CCR) may bean individual polymer having a polar function group or combined and polymerized with such polymer; or may be obtained by copolymerization of a monomer component having such a polar function group, e.g., a single function monomer such as styrene monomer, (meth)acrylic monomer and the like, and/or a multifunction monomer; or may be a polymer blend of a polymer of polymerized single function monomer and/or multifunction monomer, and a polymer continuing a monomer having a polar function group. When a charge controlling resin is added, it is desirable that the amount added is 0.1 to 5 pbw relative to 100 pbw binder resin (A).

It is desirable that various types of organic/inorganic fine particles are added to the toner as flow regulating agent after the toner particles have been manufactured. Examples of useful organic fine particles include various types of oxide compounds such as titanium oxide, magnesium oxide, aluminum oxide, silica, colloidal silica and the like, various types of titanate compounds such as potassium titanate, magnesium titanate, strontium titanate and the like, various types of metallic soaps such as aluminum stearate, calcium stearate, zinc stearate, magnesium stearate and the like, various types of nonmagnetic organic fine particles such as talc, bentonite and the like. Particularly desirable are inorganic fine particles such as silica, titanium oxide, alumina, zinc oxide and the like which has been subjected to surface processing by well-known methods using conventional hydrophobic processing agent such as silica coupling agent, titanate coupling agent, silicone oil, silicone varnish and the like, fluoride silica coupling agent, fluoride silicone oil, coupling agent having a quaternary ammonium salt group and amino group, modified silicone oil and the like. Finally, various types of organic fine particles such as styrene (meth)acrylic, benzoguanamine, melamine, teflon, silicon, polyethylene, polypropylene and the like granulated by gas-phase method, wet polymerization method such as emulsion polymerization, soap-free emulsion polymerization, nonaqueous dispersion polymerization and the like may be used for the purpose of cleaning adjuvant. Inorganic fine particles of relatively large particle size such as titanate of metal salts and various types of organic fine particles may be subjected to hydrophobic processing. These fine particles are added in the amount of 0.1 to 6 pbw, and desirably 0.5 to 5 pbw, relative to 100 pbw toner particles. These fine particles may be used in combination s of two or more types, and in such case the total amount shall be within the aforesaid range.

The obtained toner has a relatively high degree of roundness and the shape is relatively uniform, moreover small particles and large particles are not included in the toner. For this reason, charge rise characteristics are improved, the charge distribution is sharp, and as a result images are produced with scant noise such as fog and the like. The average degree of roundness of the toner is 0.955 to 1, and desirably 0.960 to 1, and the standard deviation of the degree of roundness is desirably 0.040 or less.

The toner of the present invention ensures a relatively high level of direct yield because it is manufactured at low pulverization energy without over pulverization. That is, the direct yield of the toner of the present invention is 70% or greater, desirably 75% or greater, and more desirably 80% or greater.

Since the polymer (B) has negative chargeability, the toner of the present invention effectively ensures negative chargeability by the abundance of polymer (B) in the surface layer of the toner particle even when charge controller is not added, such that the generation of opposite charged toner is suppressed. The heat-resistant storage characteristics are effectively ensures by setting a high glass transition temperature of the polymer (B) even though the binder resin (A) has a relatively low glass transition temperature since the surface layer of the toner particle is rich in polymer (B).

The toner of the present invention is effective in SURF (film) fixing method using polyimide film, and fixing devices (belt or roller fixing methods) having a fluoride resin surface layer providing excellent durability. The toner of the present invention has excellent release characteristics and anti-offset characteristics relative to fluoride surface layers providing excellent durability, and is particularly effective in shift rollers and the like using fluoride material in the surface layer, and hard rollers of teflon used in normal monochrome devices.

The toner of the present invention is desirably a negative charging toner, and may be used in a two-component developer mixed with a carrier, and may be used in a nonmagnetic monocomponent developer without carrier, or a magnetic monocomponent developer.

EXAMPLES

Production of Binder Resin (Polyester Resin) Alcohol component and acid component in the molar ratio are shown in TABLE 1 together with a polymerization initiator (dibutyl tin oxide) were introduced to a four-hole glass flask, on which was mounted a thermometer, stainless steel mixing rod, flow-type condenser, and nitrogen inlet tube. The flask was placed in a mantle heater in a nitrogen atmosphere and the material was heated, mixed and reacted. Then, the progress of the reaction was traced by measuring the acid value. At the moment when a specific acid value was attained the reactions were ended, and the material was cooled to room temperature to obtain polyester resins L1 to L5 and H1 to H5. The obtained polyester resin was coarsely pulverized to 1 mm or less individually or in combination to obtain the binder resins A1 to A15 shown in TABLE 2, and these were used to manufacture the toner. Each of the obtained polyester resins had physical properties shown in TABLE 1, and each of the binder resins had the physical properties shown in TABLE 2. In TABLE 1, P0 represents the polyoxypropylene(2,2)-2,2-bis(4-hydroxyphenyl) propane, EO represents polyoxyethylene(2,0)-2,2-bis(4-hydroxyphenyl)propane, TPA represents terephthalic acid, TMA represents trimellitic acid, and FA represents fumaric acid.

TABLE 1

| Polyester | Alcohol component | | Acid component | | | | | Tg | Tm | Acid | Hydroxyl | THF Insoluble component | Pulverization |
|---|---|---|---|---|---|---|---|---|---|---|---|---|---|
| resin | PO | EO | FA | TPA | TMA | Mn | Mw/Mn | (° C.) | (° C.) | Value* | Value* | (wt %) | index |
| L1 | 4 | 6 | — | 9 | — | 3300 | 4.2 | 68.5 | 110.3 | 3.3 | 28.1 | — | 1.9 |
| L2 | 9 | 1 | — | 8 | — | 1920 | 2.4 | 57.1 | 93.4 | 9.6 | 24.1 | — | 0.6 |
| L3 | 7 | 3 | 9 | 3 | — | 1900 | 2.5 | 48.5 | 95.5 | 18.7 | 22.5 | — | 0.5 |
| L4 | 10 | 1 | — | 3 | 6 | 6000 | 3.3 | 67.2 | 116 | 5.6 | 25.2 | 18 | 1.9 |
| L5 | 10 | 1 | 4.5 | 4.5 | — | 4500 | 4.3 | 66.5 | 111.4 | 11.4 | 26.4 | — | 2.0 |
| H1 | 5 | 5 | 7 | — | 5 | 2780 | 31 | 60.2 | 145.8 | 27.9 | 17.6 | 22 | 1.3 |
| H2 | 8 | 2 | 5 | — | 7 | 2800 | 19 | 65.4 | 156 | 34.0 | 16.5 | 20 | 1.8 |
| H3 | 7 | 3 | 4 | — | 5 | 3000 | 10 | 53.6 | 154 | 18.9 | 22.1 | 16 | 1.1 |
| H4 | 8.5 | 1.5 | — | 6 | 3 | 6800 | 14.5 | 76.4 | 139 | 2.1 | 37.9 | 17 | 2.3 |
| H5 | 7 | 3 | — | 7 | 2 | 4200 | 19 | 69.8 | 127 | 2.0 | 38.2 | 20 | 2.4 |

*Unit of Acid Value and Hydroxyl Value are KOHmg/g.

TABLE 2

| Binder resin | Kind of polyester resin H/L | Ratio of H/L (wt %) | Mn | Mw/Mn | Tg (° C.) | Tm (° C.) | Acid Value* | Hydroxyl Value* | THF Insoluble component (wt %) | Pulverization index |
|---|---|---|---|---|---|---|---|---|---|---|
| A1 | H1/L2 | 90/10 | 2650 | 28 | 60.0 | 138.5 | 26 | 18 | 20 | 1.23 |
| A2 | H1/L2 | 70/30 | 2450 | 22 | 59.0 | 129.2 | 22 | 19 | 16 | 1.09 |
| A3 | H1/L2 | 60/40 | 2370 | 19 | 59.1 | 124.0 | 20 | 20 | 13 | 1.02 |
| A4 | H1/L2 | 30/70 | 2060 | 10 | 58.0 | 108.39 | 15 | 22 | 6 | 0.81 |
| A5 | H1/L2 | 10/90 | 1930 | 5.2 | 57.3 | 98.2 | 11 | 23 | 22 | 0.67 |

TABLE 2-continued

| Binder resin | Kind of polyester resin H/L | Ratio of H/L (wt %) | Mn | Mw/Mn | Tg (° C.) | Tm (° C.) | Acid Value* | Hydroxyl Value* | THF Insoluble component (wt %) | Pulverization index |
|---|---|---|---|---|---|---|---|---|---|---|
| A6 | H2/L2 | 60/40 | 2200 | 12 | 62.1 | 129.8 | 15 | 19 | 22 | 1.32 |
| A7 | H3/L2 | 60/40 | 2460 | 7 | 55.0 | 129.0 | 15 | 23 | 9 | 0.9 |
| A8 | H5/L2 | 60/40 | 3140 | 12 | 64.5 | 113.0 | 5 | 32 | 12 | 1.68 |
| A9 | H4/L5 | 60/40 | 5900 | 9.8 | 71.0 | 127.7 | 3.5 | 32.8 | 9 | 1.46 |
| A10 | L1 | 100 | 3300 | 4.2 | 68.5 | 110.3 | 3.3 | 28.1 | — | 1.9 |
| A11 | L2 | 100 | 1920 | 2.4 | 57.1 | 93.4 | 9.6 | 24.1 | — | 0.6 |
| A12 | L3 | 100 | 1900 | 2.5 | 48.5 | 95.5 | 18.7 | 22.5 | — | 0.5 |
| A13 | L4 | 100 | 6000 | 3.3 | 67.2 | 116.0 | 5.6 | 25.2 | — | 1.9 |
| A14 | H4 | 100 | 6800 | 14.5 | 76.4 | 139.0 | 2.1 | 37.9 | 17 | 2.3 |
| A15 | H1 | 100 | 2780 | 31 | 60.2 | 145.8 | 27.9 | 17.6 | 22 | 1.3 |

*Unit of Acid Value and Hydroxyl Value are KOHmg/g.

Production of Polymer (B)

Polymer B1

150 g styrene (99.9% pure) and 150 g toluene were loaded in an autoclave and mixed at a maintained temperature of 5° C. as 1.5 g $BF_3$-phenol complex was added slowly for approximately 10 min. Thereafter, the material was mixed continuously for 3 hr. Then, 50 ml of 5% aqueous sodium hydroxide solution was added and mixed vigorously for 30 min, to dissociate the catalyst, and thereafter the water layer was separated, the polymer oil was washed until neutral, subsequently unreacted component and solvent toluene were removed to obtain the polystyrene as a residue. This polystyrene was designated polymer B1, and its physical characteristics are shown in TABLE 3.

Polymer B2

150 g α-methylstyrene (99.9% pure) and 150 g toluene were loaded in an autoclave and mixed at a maintained temperature of 5° C. as 1.5 g $BF_3$-phenol complex was added slowly for approximately 10 min. Thereafter, the material was mixed continuously for 3 hr. Then, 50 ml of 5% aqueous sodium hydroxide solution was added and mixed vigorously for 30 min, to dissociate the catalyst, and thereafter the water layer was separated, the polymer oil was washed until neutral, subsequently unreacted component and solvent toluene were removed to obtain the poly-α-methylstyrene as a residue. This poly-α-methylstyrene was designated polymer B2, and its physical characteristics are shown in TABLE 3.

Polymer B3

Polystyrene was obtained and designated polymer B3 by the same method as polymer B1 with the exception that the reaction time was 2 hr; physical properties are shown in TABLE 3.

Polymer B4

Poly-α-methylstyrene was obtained and designated polymer B4 by the same method as polymer B2 with the exception that the reaction time was 4.5 hr; physical properties are shown in TABLE 3.

Polymer B5

Isopropenyltoluene and indene (molar ratio: 40/60; total amount: 500 ml) and 500 ml toluene were loaded in an autoclave and mixed at a maintained temperature of 5° C. as 1.5 g $BF_3$-phenol complex was added slowly for approximately 10 min. Thereafter, the material was mixed continuously for 3 hr. Then, 50 ml of 5% aqueous sodium hydroxide solution was added and mixed vigorously for 30 min, to dissociate the catalyst, and thereafter the water layer was separated, the polymer oil was washed until neutral, subsequently unreacted component and solvent toluene were removed to obtain the isopropenyltoluene-indene copolymer as a residue. This polymer was designated polymer B5, and its physical characteristics are shown in TABLE 3. The offensive odor of polymer B5 was a problem. The total VOC was measured at 510 ppm by headspace gas chromatography.

TABLE 3

| Sample | Polymer (B) | Mw | Mn | Mw/Mn | Tg (° C.) | Tm (° C.) | Pulverization index |
|---|---|---|---|---|---|---|---|
| B1 | Polystyrene | 1500 | 1000 | 1.5 | 62 | 120 | 0.3 |
| B2 | Poly-α-methylstyrene | 2800 | 1500 | 1.9 | 75 | 140 | 0.5 |
| B3 | Polystyrene | 900 | 650 | 1.4 | 72 | 108 | 0.2 |
| B4 | Poly-α-methylstyrene | 3100 | 1700 | 1.8 | 65 | 147 | 0.7 |
| B5 | Isopropenyltoluene-indene copolymer | 2600 | 1400 | 1.9 | 40 | 134 | 0.5 |

Production of Pigment Master Batch

The pigment used in producing full color toner was a pigment master batch obtained by the following method. The binder resin and pigment used in each example and reference example were loaded in a pressure kneader at a weight ratio (resin: pigment) of 7:3, kneaded for 1 hr at 120° C., cooled, and thereafter coarsely pulverized by a hammer mill to obtain pigment master batches having a 30 wt % pigment content for each color yellow, magenta, and cyan. C.I. pigment yellow 180 (Hoechst), C.I. pigment blue 15-3 (Dainippon Ink and Chemicals, Inc.), and C.I. pigment red 184 (Dainippon Ink and Chemicals, Inc.) was used as pigments.

Production of Toner

Example 1

Toner Y1

The binder resin A3 and pigment master batch were used in the amounts of 100 pbw binder resin A3 and 7.0 pbw C.I. pigment yellow 180, to which was added 5 pbw polymer B2, 5 pbw oxided polyethylene wax (Sanwax E250P; Sanyo Chemical Industries, Ltd.; softening point 103.5° C.; acid value 19.5 KOHmg/g), and 3 pbw oxided polypropylene wax (Biscol 110TS; Sanyo Chemical Industries, Ltd.; softening point 140° C.; acid value 3.5 KOHmg/g), and after the material was mixed for 5 min in a Henschel mixer at a speed of 40 m/s and the specimen temperature was controlled so as to not surpass 45° C. or higher, the material was subjected to high temperature fusion kneading at a maximum temperature of 200° C. using the a two-shaft extrusion kneader (model PCM-30; Ikegai Tekko K.K.) from which the discharge unit had been removed. The pass-through time of the processed material was approximately 1 min. The obtained kneaded material was rolled 2 mm by a cooled press roller, and after cooling by a cooling belt, was coarsely pulverized by a feather mill (2 mm pass mesh). Thereafter, the material was pulverized to an average particle size of approximately 10 μm by a mechanical pulverizer (KTM: Kawasaki Heavy Industries, Ltd.), then finely pulverized to an average particle size of 5.8 μm by a jet pulverizer (IDS; Nippon Pneumatic Mfg. Co., Ltd.), and subsequently roughly classified, then finely classified using a rotor-type classification device (T-plex classifier model 100ATP; Hosokawa Micron Corp.) to obtain yellow toner particles having a volume-average particle size of 6.1 μm, 0 wt % content of particles of a particle size double (2D) or greater the volume-average particle size (D), and 0 vol % content of particles of a particle size of 2.5 μm or less. The average degree of roundness of these toner particles was 0.962, and the standard deviation of the degree of roundness was 0.037. To 100 pbw of these toner particles was added 0.5 pbw hydrophobic silica (H-2000; Clariant Japan K.K.), 1.0 pbw titanium oxide (STT30A; Titan Kogyo K.K.), and 1.0 pbw strontium titanate (average particle size 0.2 μm), and the mixture was processed in a Henschel mixer (speed 40 m/sec for 60 seconds) and sifted using a sieve having a mesh of 90 μm to obtain yellow toner Y1.

Examples 2, 3

Toner C1, M1

Toner C1 and M1 were obtain by the same method as in example 1 with the exception that the pigment master batch was changed, and the binder resin A3 and pigment master batches used were 100 pbw binder resin A3 and 5.0 pbw C.I. pigment blue 15-3, and 100 pbw binder resin A3 and 4.5 pbw C.I. pigment red 184.

Example 4

Reference Examples 1 to 3

Toners C2 to C5

Toners C2 to C5 were obtained by the same method as used in example 2 with the exception that the polymer B2 was replaced by polymers B1, B3 to B5, respectively.

Examples 5 to 7, Reference Example 4; Examples 8 to 10, Reference Examples 5 to 10 and 12

Toners C6 to C18, C22

Toners C6 to C18 and C22 were obtained by the same method as used in example 2 with the exception that the binder resin A3 was replaced by binder resins A1, A2, A4 to 15, respectively.

Example 11, Reference Example 11

Toners C19, C20

Toner C19 and C20 were obtained in the same manner as example 2 with the exception that the amount of polymer B2 added was changed to 8 pbw and 0 pbw (none added), respectively.

Example 12

Toner C21

Toner C21 was obtained by the same method as used in example 2 with the exception that polyethylene wax was not added.

Example 13

Toner Bk1

Toner Bk1 was obtained by the same method as used in example 1 with the exception that the pigment master batch was changed to oxided carbon black (Mogul L; Cabot Corp.; pH2.5, average primary particle size 24 nm), and the binder resin A3 and oxided carbon black were used at a rate of 100 pbw binder resin A3, 8.0 pbw oxided carbon black.

Toner manufacturing conditions and physical properties are shown in TABLE 4.

TABLE 4

| | Toner | Binder resin | Polymer (B) Kind | Polymer (B) Amount* | Average particle size | >2D (wt %) | <2.5 μm (vol %) | Average roundness | SD of roundness | Yield of toner (wt %) | VOC amount |
|---|---|---|---|---|---|---|---|---|---|---|---|
| Ex. 1 | Y1 | A3 | B2 | 5 | 6.1 μm | 0 | 0 | 0.962 | 0.037 | 82 | ◎ |
| Ex. 2 | C1 | A3 | B2 | 5 | 6.0 μm | 0 | 0 | 0.961 | 0.036 | 81 | ◎ |
| Ex. 4 | C2 | A3 | B1 | 5 | 6.0 μm | 0 | 0 | 0.962 | 0.036 | 80 | ◎ |
| Com. Ex. 1 | C3 | A3 | B3 | 5 | 6.1 μm | 0 | 0 | 0.961 | 0.036 | 76 | X |
| Com. Ex. 2 | C4 | A3 | B4 | 5 | 6.0 μm | 0 | 0.5 | 0.956 | 0.041 | 68 | X |
| Com. Ex. 3 | C5 | A3 | B5 | 5 | 6.0 μm | 0 | 0.2 | 0.958 | 0.042 | 65 | X |
| Ex. 5 | C6 | A1 | B2 | 5 | 6.1 μm | 0 | 0 | 0.957 | 0.036 | 81 | ◎ |
| Ex. 6 | C7 | A2 | B2 | 5 | 6.1 μm | 0 | 0 | 0.961 | 0.037 | 81 | ◎ |
| Ex. 7 | C8 | A4 | B2 | 5 | 6.1 μm | 0 | 0 | 0.962 | 0.036 | 80 | ◎ |
| Com. Ex. 4 | C9 | A5 | B2 | 5 | 6.1 μm | 0 | 0 | 0.960 | 0.037 | 78 | ◎ |
| Ex. 8 | C10 | A6 | B2 | 5 | 6.0 μm | 0 | 0 | 0.961 | 0.038 | 79 | ◎ |
| Ex. 9 | C11 | A7 | B2 | 5 | 5.9 μm | 0 | 0 | 0.961 | 0.037 | 79 | ◎ |
| Ex. 10 | C12 | A8 | B2 | 5 | 6.0 μm | 0 | 0 | 0.962 | 0.036 | 82 | ◎ |
| Com. Ex. 5 | C13 | A9 | B2 | 5 | 6.1 μm | 0.4 | 0.2 | 0.962 | 0.039 | 74 | ◎ |
| Com. Ex. 6 | C14 | A10 | B2 | 5 | 6.0 μm | 0 | 0 | 0.960 | 0.037 | 80 | ◎ |
| Com. Ex. 7 | C15 | A11 | B2 | 5 | 5.9 μm | 0 | 0 | 0.958 | 0.037 | 65 | ◎ |
| Com. Ex. 8 | C16 | A12 | B2 | 5 | 5.9 μm | 0 | 0 | 0.959 | 0.037 | 67 | ◎ |
| Com. Ex. 9 | C17 | A13 | B2 | 5 | 6.0 μm | 0 | 0 | 0.960 | 0.037 | 73 | ◎ |
| Com. Ex. 10 | C18 | A14 | B2 | 5 | 6.0 μm | 0 | 0 | 0.960 | 0.037 | 76 | ◎ |
| Ex. 11 | C19 | A3 | B2 | 8 | 6.0 μm | 0 | 0 | 0.961 | 0.039 | 79 | ◎ |

TABLE 4-continued

| | Toner | Binder resin | Polymer (B) Kind | Polymer (B) Amount* | Average particle size | >2D (wt %) | <2.5 μm (vol %) | Average roundness | SD of roundness | Yield of toner (wt %) | VOC amount |
|---|---|---|---|---|---|---|---|---|---|---|---|
| Com. Ex. 11 | C20 | A3 | — | 0 | 6.0 μm | 0.5 | 0.7 | 0.963 | 0.040 | 47 | ◎ |
| Ex. 12 | C21 | A3 | B2 | 5 | 6.0 μm | 0 | 0 | 0.961 | 0.037 | 75 | ◎ |
| Ex. 3 | M1 | A3 | B2 | 5 | 6.0 μm | 0 | 0 | 0.961 | 0.036 | 81 | ◎ |
| Ex. 13 | Bk1 | A3 | B2 | 5 | 6.1 μm | 0 | 0 | 0.961 | 0.036 | 80 | ◎ |
| Com. Ex. 12 | C22 | A15 | B2 | 5 | 6.1 μm | 0.5 | 0 | 0.961 | 0.037 | 66 | ◎ |

Amount* shows amount of polymer (B) (part by weight) relative to 100 parts by weight of binder resin.

The volume-average particle size of the toner, and the total content of particles of a particle size double (2D) or greater the volume-average particle size (D), and the total content of particles of a particle size of 2.5 μm or less were measured using a 50 μm aperture tube and a Coulter Multisizer II (Beckman Coulter).

The degree of roundness is represented by "circumferential length/particle projection image circumferential length of an equivalent circle. "The average degree of roundness was measured by an aqueous dispersion system using a Sheath Flow Particle Image Analyzer (FPIA-2000; Sysmex Corp.). The standard deviation of the degree of roundness was also analyzed.

Toner yield was calculated by measuring the total weight of toner material used and the weight of toner obtained, and performing the calculation of the equation below.

$$\text{Yield}=(\text{weight of obtained toner})/(\text{total weight of toner material})\times 100$$

Measurement of the VOC (volatile component) amount in the amount of polymer (B) used is accomplished by head-space gas chromatography. Acetone, benzene, toluene, and residual monomer were detected as the volatile component. Evaluation was performed by the criteria below, and the worst evaluation results are shown.

Total VOC

Less than 400 ppm: ◎, 400 ppm or more but less than 700 ppm: ○, 700 ppm or more but less than 1000 ppm: Δ, 1000 ppm or more ×.

Acetone

Less than 1 ppm: ◎, 1 ppm or more but less than 3 ppm: ○, 3 ppm or more but less than 5 ppm: Δ, 5 ppm or more ×.

Benzene

Not detected: ◎, detected: ×.

The obtained toner was evaluated by each criterion, and the evaluation results are shown in TABLE 5.

(Heat-resistant Storage Characteristics: H.R.S. in TABLE 5)

20 g toner was weight in 100 cc glass screw tube, and allowed to stand for S hr at 60° C., and thereafter the toner flocculation state was ranked and evaluated.

○: No flocculated toner, completely problem free

Δ: Light flocculation quickly dispersed by light force, no practical problem

×: Severe flocculation not easily released, impractical for use (Dispersed Particle Size of Polymer (B) and Release Agent)

Toner particles were sliced by microtome, stained with osmium stain, photographed at 10,000× by transmission electron microscope (TEM), and the photographic image was loaded in an image analyzer (Luzex 5000; Nireco Corp.), and the particle distribution of the polymer (B) and release agent in the particle was measured. When the dispersion shape was not completely spherical, the circular equivalent particle size of the cross section area of the dispersed particle was calculated.

Evaluation as a Monocomponent Developer (Adhesion State)

Each toner was loaded in a toner cartridge of a printer (Intercolor LP 3000C; Seiko Epson Corp.), and 1,000 sheets were printed of an image having a 6% B/W ratio, and thereafter the adhesion state on the regulating blade surface was examined.

When evaluating the toner of the monocomponent developer, each toner was used with the 0.5 pbw hydrophobic silica (Clariant Japan K.K.) used in post-processing modified to 0.5 pbw TS-500 (Cabot Corp.). Other post-processing agents were identical in toners used in two-component developers.

Evaluation as a Two-component Developer

A binder-type carrier was manufactured to evaluate the toners of the examples and reference examples as two-component developers.

(Production of Binder-type Carrier)

100 pbw polyester resin (NE-1110; Kao Corp.), 700 pbw magnetic particles (magnetite EPT-1000; Toda Kogyo Corp.), and 2 pbw carbon black (Mogul L; Cabot Corp.) were thoroughly mixed in a Henschel mixer, and fusion kneaded using a two-shaft extrusion kneader with the cylinder temperature set at 180° C., and 170° C. The kneaded material was cooled, and coarsely pulverized by a hammer mill, finely pulverized by jet pulverizer, and classified to obtain a binder-type carrier having a volume-average particle size of 35 μm. The carrier particle size was measured a 150 μm aperture tube and a Coulter Multisizer II (Beckman Coulter).

(Chargeability)

In order to evaluate the charge rise of the two-component developer, toner and carrier were prepared with a toner ratio of 14 wt %, and the amount of charge at 1 min, 5 min, and 30 min was measured electrolytic separation.

In order to evaluate charge stability endurance time in a separate evaluation toner and carrier were mixed at a toner ratio of 14 wt % in a holder for 12 hr, and thereafter toner was electrolytically separated from the carrier surface. Thereafter, using the separated carrier, toner and carrier were again prepared at a toner ratio of 7 wt % and the amount of charge at 1 min, 5 min, and 30 min was measured by electrolytic separation.

Based on the results, toners were ranked excellent (○), practical (Δ), and impractical (×) using as a basis whether or not the charge rise performance, and endurance performance (charge stability) were of a level sufficient for practical use.

Below, a digital copier (DiALTA Di350; Minolta Co., Ltd.) was used. Specifically, the fixing device of this digital copier has a web roller used for roller cleaning, and uses an oil-less fixing method.

(Release Efficiency, Anti-offset Efficiency and Fixing Strength: R-A.E. in TABLE 5)

Each toner was combined with the binder-type carrier at a toner ratio of 7 wt %, mixed in a holder for 30 min to prepare a starter, and used in the digital copier (DiALTA Di350; Minolta Co., Ltd.) to form images; the toners were evaluated. The fixing device of the copier was evaluated using a Teflon hard roller, and a shift-type soft roller having a surface layer of fluoride resin. A test pattern was evaluated using a printed sample of a gradient pattern (the maximum amount of toner of the gradient patter was 1.5 mg/cm$^2$) 20 mm wide to a 5 mm tip on an A4 portrait oriented sheet assuming the amount of toner adhered in a three-color overlay. The fixing temperature was changed at 2° C. increments within a range of 120 to 200° C., and the results evaluated.

Release Efficiency, Anti-offset Efficiency

◎: When using both soft roller and hard roller fixing devices, the print sheet did not wrap around the fixing roller and fed properly; anti-offset temperature range of 50° C. and higher ensured ○: When using both soft roller and hard roller fixing devices, the print sheet did not wrap around the fixing roller and fed properly; anti-offset temperature range of 50° C. and higher ensured Δ: When using both soft roller and hard roller fixing devices, the print sheet did not wrap around the fixing roller and fed properly; anti-offset temperature range of 30° C. and higher ensured ×: When using both soft roller and hard roller fixing devices, the print sheet did not wrap around the fixing roller and fed properly; anti-offset temperature range less than 30° C. ensured.

Fixing Strength

A soft roller fixing device and a hard roller fixing device were used to fix images which were folded twice from the center, and the peeling characteristics were evaluated visually. Only images that could be fixed were used.

◎: No white streaks in the image; practical for use

○: Some white streaks in image; practical for use

Δ: Some white streaks in image; practical for some uses

×: White streaks in image; impractical for use (Fog)

Each toner was mixed with binder-type carrier at a toner ratio of 7 wt % to prepare starter, and each starter was loaded in a digital copier (DiALTA Di350; Minolta Co., Ltd.), and 3,000 sheets printed of a 7% B/W image under environmental conditions of 25° C. and 55%RH.

○: No fog; not deterioration of image quality

Δ: Slight fog; slight deterioration of image quality (no problem for practical use)

×: Fog; deterioration of image quality observed (Gloss)

Each toner was combined with binder-type carrier at a toner ratio of 7 wt % and mixed for 30 min in a holder to prepare starter, and solid images were printed using a digital copier (DiALTA Di350; Minolta Co., Ltd.). The fixing temperature was changed in 2° C. increments in a range of 120 to 200° C. Evaluation was accomplished by measuring glossiness using a portable gloss meter (GMX-202/7S°; Murakami Color Research Laboratory), based on the range of fixing temperature at which an image was obtained having a gloss of 30° or more.

○: Range of 30° or more

×: Range of less than 30°

Each toner Y1, C1, M1, Bk1 was mixed with binder-type carrier at a toner ratio of 7 wt % to prepare starter, and each starter was loaded in a digital copier (DiALTA Di350; Minolta Co., Ltd.) in which the structure of the fluoride surface agent on the shift roller in the fixing device was changed, and an endurance test of 3,000 sheets was performed by printing a full color image having 8% B/W ratio at NN environmental condition (25° C., 55%RH). Results were that neither fog nor image quality deterioration were observed.

TABLE 5

| | | | Particle size of | Particle size | Monocomponent | Two-component developer | | | | |
|---|---|---|---|---|---|---|---|---|---|---|
| | Toner | H.R.S. | polymer (B) (μm) | of release agent (μm) | developer Adhesion state | Charge-ability | Fog | R-A.E. | Fixing Strength | Gloss |
| Ex. 1 | Y1 | ○ | 0.6 | 1.0 | No Adhesion | ○ | ○ | ◎ | ◎ | ○ |
| Ex. 2 | C1 | ○ | 0.5 | 1.1 | No Adhesion | ○ | ○ | ◎ | ◎ | ○ |
| Ex. 4 | C2 | ○ | 0.5 | 1.0 | No Adhesion | ○ | ○ | ◎ | ◎ | ○ |
| Com. Ex. 1 | C3 | X | 0.5 | 1.1 | Adhesion | X | X | X | ○ | ○ |
| Com. Ex. 2 | C4 | ○ | 1.1 | 1.9 | Adhesion | Δ | Δ | ○ | ○ | ○ |
| Com. Ex. 3 | C5 | ○ | 1.6 | 1.0 | No Adhesion | ○ | ○ | ○ | ○ | ○ |
| Ex. 5 | C6 | ○ | 0.6 | 0.9 | No Adhesion | ○ | ○ | Δ | Δ | ○ |
| Ex. 6 | C7 | ○ | 0.6 | 1.1 | No Adhesion | ○ | ○ | ◎ | ◎ | ○ |
| Ex. 7 | C8 | ○ | 0.5 | 1.2 | No Adhesion | ○ | ○ | ◎ | ◎ | ○ |
| Com. Ex. 4 | C9 | ○ | 0.5 | 1.3 | Adhesion | Δ | Δ | X | ○ | ○ |
| Ex. 8 | C10 | ○ | 0.6 | 1.2 | No Adhesion | ○ | ○ | ◎ | Δ | ○ |
| Ex. 9 | C11 | Δ | 0.5 | 1.2 | No Adhesion | ○ | ○ | ◎ | ○ | ○ |
| Ex. 10 | C12 | ○ | 0.5 | 1.5 | No Adhesion | ○ | ○ | ◎ | Δ | ○ |
| Com. Ex. 5 | C13 | ○ | 0.6 | 1.8 | No Adhesion | ○ | ○ | X | X | X |
| Com. Ex. 6 | C14 | ○ | 0.6 | 1.8 | No Adhesion | Δ | Δ | X | X | ○ |
| Com. Ex. 7 | C15 | Δ | 0.6 | 1.2 | Adhesion | ○ | ○ | X | X | ○ |
| Com. Ex. 8 | C16 | X | 0.5 | 1.2 | Adhesion | X | X | X | X | ○ |
| Com. Ex. 9 | C17 | ○ | 0.6 | 1.3 | No Adhesion | ○ | ○ | X | X | ○ |
| Com. Ex. 10 | C18 | ○ | 0.6 | 1.9 | No Adhesion | ○ | ○ | X | X | X |
| Ex. 11 | C19 | ○ | 0.8 | 1.1 | No Adhesion | ○ | ○ | ◎ | ◎ | ○ |
| Com. Ex. 11 | C20 | Δ | — | 1.6 | Adhesion | X | X | ○ | ○ | ○ |
| Ex. 12 | C21 | ○ | 0.6 | 0.9 | No Adhesion | ○ | ○ | ○ | ○ | ○ |

TABLE 5-continued

| | Toner | H.R.S. | Particle size of polymer (B) (μm) | Particle size of release agent (μm) | Monocomponent developer Adhesion state | Two-component developer Charge-ability | Fog | R-A.E. | Fixing Strength | Gloss |
|---|---|---|---|---|---|---|---|---|---|---|
| Ex. 3 | M1 | ○ | 0.6 | 0.9 | No Adhesion | ○ | ○ | ◎ | ◎ | ○ |
| Ex. 13 | Bk1 | ○ | 0.6 | 0.9 | No Adhesion | ○ | ○ | ◎ | ◎ | ○ |
| Com. Ex. 12 | C22 | ○ | 0.6 | 1.4 | No Adhesion | ○ | ○ | ◎ | ○ | X |

(Other Measurements)

Measurement of Resin Glass Transmission

Temperature Tg

A differential scanning calorimeter (DSC-200; Seiko Instruments, Inc.) was used to measure a 10 mg specimen between 20 to 120° C. with a temperature rise of 10° C./min using alumina as a reference; the shoulder value of the main endothermic peak was designated the glass transition point.

Measurement of the Resin Softening Point Tm

Using a flow tester (model CFT-500; Shimadzu corp.), the temperature equivalent to ½ the height from the flow start point to the flow endpoint was designated the softening point when a 1 $cm^3$ specimen was melted to flow under 20 $kg/cm^2$ pressure, temperature rise speed of 6° C./min, a dice pore (1 mm diameter; 1 mm length).

Molecular weight was determined by polystyrene conversion using tetrahydrofuran as a carrier solvent, and using gel permeation chromatography (model 807-IT; JASCO Corp.).

Acid value is a value calculated from the amount of N/10 potassium hydroxide/alcohol solution consumed by titrating indexed N/10 potassium hydroxide/alcohol solution using 10 mg specimen dissolved in 50 ml toluene and a mix indicator of 0.1% bromothymol blue and phenol red.

Hydroxyl value is represented as the milligrams of potassium hydroxide required to neutralize the acetic acid released when weighed material is processed with acetic anhydride and the obtained acetyl compound is hydrolyzed.

Tetrahydrofuran (THF) insoluble component is calculated by adding 5 g (X) resin to 100 g tetrahydrofuran at 25° C., mixing for 24 hr, and when the obtained solution is filtered under pressure, the component residue on the filter paper is dried, and the residue weight is measured.

$$\text{Insoluble } THF = (\text{weight of residue})/X \times 100$$

Pulverization Index

When a specimen (i.e., binder resin, polymer (B), or toner composition coarsely pulverized to a volume-average particle size of approximately 2 mm) is pulverized at a processing quantity F (5 kg/h) and KTM rotation speed 12,000 (rpm) using a mechanical pulverization device (model KTM-0; Kawasaki Heavy Industries, Ltd), the load force value W0 is recorded when no specimen passes through, and the load force W1 is recorded when specimen passes through. Thereafter, the volume-average particle size D (μm) of the pulverized material obtained by KTM pulverization is measured by a Coulter Multisizer II (Beckman Coulter Co.). The pulverization index is calculated from the obtained values based on the equation below.

$$\text{Pulverization index} = (D \times (W1 - W0))/F$$

Although the present invention has been fully described by way of examples with reference to the accompanying drawings, it is to be noted that various changes and modifications will be apparent to those skilled in the art.

Therefore, unless otherwise such changes and modifications depart from the scope of the present invention, they should be construed as being included therein.

What is claimed is:

1. A toner for developing an electrostatic latent image comprising:

a colorant;

a binder resin having a number-average molecular weight of 2000 to 5000 and a ratio of weight-average molecular weight/number-average molecular weight of 5 to 30;

a polymer having a weight-average molecular weight of 1000 to 3000 and a ratio of weight-average molecular weight/number-average molecular weight of 2.0 or less; and a release agent.

2. The toner of claim 1, wherein the binder resin has a glass transition point of 50 to 70° C. and a softening point of 95 to 160° C.

3. The toner of claim 2, wherein the polymer has a glass transition point of 50 to 85° C. and a softening point of 100 to 160° C.

4. The toner of claim 1, wherein the average particle size of the polymer is smaller than that of the release agent.

5. The toner of claim 1, wherein the release agent has a softening point of 60 to 150° C., an amount of the release agent being 2 to 20 parts-by-weight relative to 100 parts-by-weight of the binder resin, an amount of the polymer being 1.5 to 25 parts-by-weight relative to 100 parts-by-weight of the binder resin.

6. The toner of claim 1, wherein the release agent comprises a first wax having a first softening point of 60 to 110° C. and a second wax having a second softening point of 110 to 150° C., a difference of the second softening point and the first softening point being at least 20° C.

7. The toner of claim 6, wherein the first wax is polyethylene wax and the second wax is polypropylene wax.

8. The toner of claim 7, wherein the polyethylene wax has an acid value of 0.5 to 30 KOHmg/g and the polypropylene wax has an acid value of 0.5 to 30 KOHmg/g.

9. The toner of claim 1, wherein the polymer is a homopolymer or a copolymer of a styrene type monomer.

10. The toner of claim 9, wherein the styrene type monomer is a monomer selected from the group consisting of styrene, vinyltoluene, α-methylstyrene and isopropenyltoluene.

11. The toner of claim 1, wherein the polymer is polystyrene having a weight-average molecular weight of 1000 to 2000.

12. The toner of claim 1, wherein the polymer is poly-α-methylstyrene having a weight-average molecular weight of 2000 to 2800.

13. The toner of claim 1, which has an average degree of roundness of 0.955 to 1.

14. The toner of claim 1, which has a standard deviation of degree of roundness of not more than 0.040.

15. A toner for developing an electrostatic latent image comprising:

a colorant;

a binder resin having a number-average molecular weight of 2000 to 5000, a ratio of weight-average molecular weight/number-average molecular weight of 5 to 30, a glass transition point of 50 to 70° C. and a softening point of 95 to 160° C., the binder resin comprising a first polyester resin having a softening point of 80 to 125° C. and a second polyester resin having a softening point of 130 to 160° C.;

a polymer having a weight-average molecular weight of 1000 to 3000, a ratio of weight-average molecular weight/number-average molecular weight of 2.0 or less, a glass transition point of 50 to 85° C. and a softening point of 100 to 160° C.; and a release agent.

16. The toner of claim 15, wherein the binder resin has an acid value of 5 to 50 KOHmg/g.

17. The toner of claim 15, wherein the release agent comprises a first wax having a first softening point of 60 to 110° C. and a second wax having a second softening point of 110 to 150° C., a difference of the second softening point and the first softening point being at least 20° C.

18. The toner of claim 15, which has an average degree of roundness of 0.955 to 1 and a standard deviation of degree of roundness of not more than 0.040.

19. A toner for developing an electrostatic latent image comprising:

a colorant;

a binder resin having a number-average molecular weight of 2000 to 5000 and a ratio of weight-average molecular weight/number-average molecular weight of 5 to 30;

a polymer having a weight-average molecular weight of 1000 to 3000 and a ratio of weight-average molecular weight/number-average molecular weight of 2.0 or less; and a release agent, wherein the polymer and the release agent are dispersed in the binder resin, an average particle size of the polymer being 1.5 $\mu$m or less and an average particle size of the release agent being 1.5 $\mu$m or less.

20. A toner for developing an electrostatic latent image comprising:

a colorant;

a binder resin having a number-average molecular weight of 2000 to 5000, a ratio of weight-average molecular weight/number-average molecular weight of 5 to 30, a glass transition point of 50 to 70° C. and a softening point of 95 to 160° C., the binder resin comprising a first polyester resin having a softening point of 80 to 125° C. and a second polyester resin having a softening point of 130 to 160° C.;

a polymer having a weight-average molecular weight of 1000 to 3000, a ratio of weight-average molecular weight/number-average molecular weight of 2.0 or less, a glass transition point of 50 to 85° C. and a softening point of 100 to 160° C.; and a release agent, wherein the polymer and the release agent are dispersed in the binder resin, an average particle size of the polymer being 1.5 $\mu$m or less and an average particle size of the release agent being 1.5 $\mu$m or less, the average particle size of the polymer being smaller than that of the release agent.

* * * * *

UNITED STATES PATENT AND TRADEMARK OFFICE

CERTIFICATE OF CORRECTION

PATENT NO. : 6,656,655 B2
DATED : December 2, 2003
INVENTOR(S) : Masahiro Anno et al.

It is certified that error appears in the above-identified patent and that said Letters Patent is hereby corrected as shown below:

Title page,
Item [75], Inventors, the name of the second inventor is corrected to read as
-- Yoshihiro Mikuriya --.

Signed and Sealed this

Eighth Day of June, 2004

JON W. DUDAS
*Acting Director of the United States Patent and Trademark Office*